United States Patent [19]

Miller

[11] Patent Number: 4,626,105

[45] Date of Patent: Dec. 2, 1986

[54] MEDICATION ORGANIZER

[76] Inventor: Larry D. Miller, Rte. 4, Box 494, Springhill Rd., Somerville, Ala. 35670

[21] Appl. No.: 835,892

[22] Filed: Mar. 4, 1986

[51] Int. Cl.[4] ..... G04B 47/00

[52] U.S. Cl. ..... 368/10; 221/2

[58] Field of Search ..... 368/10, 107–109; 221/2, 3, 15; 340/309.15, 309.4

[56] References Cited

U.S. PATENT DOCUMENTS

| | | | |
|---|---|---|---|
| 4,223,801 | 9/1980 | Carlson | 221/3 |
| 4,258,354 | 3/1981 | Carmon et al. | 368/10 |
| 4,361,408 | 11/1928 | Wirtschafter | 221/2 |
| 4,382,688 | 5/1983 | Machamer | 568/10 |
| 4,419,016 | 12/1983 | Zoltan | 368/10 |
| 4,448,541 | 5/1984 | Wirtschafter | 368/10 |
| 4,483,626 | 11/1984 | Noble | 368/10 |
| 4,526,474 | 7/1985 | Simon | 368/10 |

*Primary Examiner*—Vit W. Miska

*Attorney, Agent, or Firm*—George J. Porter

[57] ABSTRACT

An improved and simplified pill dispenser for patients required to take medication comprising a plurality of compartments (A, B, C, and D of FIG. 1) each containing one or more different kinds of pills but all of such pills falling into a class of pills having the same daily morning start-up time and the same time interval between the taking of each pill, a real time clock (RTC) (28), a control panel (FIG. 2) unique to each compartment and comprising, first and second indicators (19 and 20 of FIG. 2) for indicating, respectively, the morning start-up time and the time interval between taking pills, and a time readout indicator (18 of FIG. 2) indicating when the next pill is to be taken. Also provided are a comparator (170 of FIG. 6) for comparing the RTC time with the contents of the readout indicators, an alarm (203 of FIG. 6) responsive to the coincidence of the real time and the contents of the readout indicator to alert the patient to take his pills, a first energizer for transferring the contents of the start-up time indicator (20 of FIG. 2) to the readout indicator at the patient's bedtime, and other energizers (12 and 14 of FIG. 2) energizable by the patient to selectively transfer either the contents of the RTC to the time readout indicator and then add the time interval in the second indicator (19 of FIG. 2) to the contents of the time readout indicator (18 of FIG. 2) or, alternatively, to simply add the time interval to the contents of the time readout indicator (18), depending on how long before or after coincidence between the RTC time and the contents of the time readout indicator ocurred after the other energizers were energized.

12 Claims, 10 Drawing Figures

| HOURS TIME | HOURS TENS | HOURS UNITS | OUTPUT 8421 |
|---|---|---|---|
| 10 | 1 | 0000 | 1010 |
| 11 | 1 | 0001 | 1011 |
| 12 | 1 | 0010 | 1100 |

240

MEDICATION ORGANIZER

TECHNICAL FIELD

This invention relates generally to a device for monitoring the times of day that various medicines should be taken by a patient and reminding the patient of such needs and more particularly to an improved and simplified device for reminding a patient of the various times of day when each medicine or pill should be taken and for correcting or adjusting to new reference times daily when a patient inadvertently takes one or more of his medicines too late or too early.

BACKGROUND OF THE INVENTION

Several such devices exist in the prior art, but none with the simplicity and precision of the present invention. U.S. Pat. No. 4,483,626 to NOBLE shows a device for reminding a patient that the correct intervals of time have elapsed for taking another dosage of a particular type of medicine and sounds an alarm which can be worn on the patient's wrist like a watch and activated by a radio signal transmission. However, if the patient fails to take the medicine the device will simply reset the time interval and sound another alarm when the next dosage is due.

There are no provisions for insuring that the patient has actually taken his medicine or for correcting for those times when the patient takes his medicine an hour or so too early or too late.

U.S. Pat. No. 4,526,474 to Simon shows a device for storing and periodically announcing the time for removal of drug dosages in pill, tablet, or capsule form. The device contains a number of plastic blisters each containing a single pill. When the time to take a pill has come, an electrical impulse ruptures the blister and sounds an alarm informing the patient that it is time to take a pill. As in the case of U.S. Pat. No. 4,483,626 discussed above, there are no provisions to allow the patient to record that he has taken the medicine. The device simply resets the timer and ruptures another blister when it is time to take the next pill. If the patient must take more than one type pill at another time interval then another board of blisters is required as well as another timer and the associated control circuits.

U.S. Pat. No. 4,382,688 shows a pill dispenser with a timer that sounds an alarm when it is time for the patient to take a pill. When the patient opens the pill container, the alarm ceases and the timer resets. However, only one type pill per box and per timer is accommodated. A separate box, timer, and alarm is required for each different type pill.

It should be noted that in most states pills must be kept by the patient in the same dispenser he obtained from his pharmacist. This is required by law. Obviously, this is not true in the case of the prior art patents discussed above.

Other prior art patents which show one or two features of the present invention but none of which are regarded as being sufficiently relevant to warrant individual discussion are U.S. Pat. Nos. 4,419,016, 4,448,541, and 4,361,408 issued respectively to Zoltan, Wirtschafter, and Wirtschafter.

It would mark a definite improvement in the art to provide a single container medication organizer which would not only indicate to the patient when each medication was due to be taken, but would also provide for a response from the patient that the pill had been taken, and further indicate the time when the next dosage of each different type of pill was due to be taken, and further would allow and correct for instances when the patient took his medication much too early or much too late, or had simply carried the pills in his pocket for a half day or so and had never responded to the alarm activated by the invention.

OBJECTS OF THE INVENTION

Accordingly, it is a primary object of the invention to provide an improved unitary device for storing a plurality of different types of medicines such as pills and sounding an alarm at preset periodic intervals when it is time for the patient to take one of the pills, and further to provide means for the patient to acknowledge the alarm and indicate that he has taken the prescribed pill.

Another primary object of the invention is to reset a time readout indicator in response to the patient's acknowledgement of the alarm to indicate when the next time arrives to take another of the prescribed pills.

Yet another object is to provide a unitary device for reminding a patient by an alarm that it is time to take a particular one of a number of different types of pills and to automatically reset a time readout indicator upon acknowledgement, by the patient, of the alarm as to when it is time to take another pill of the same type and further to have the ability to correct the time readout indicator to a corrected time readout when the patient takes his pill earlier or later than he should have by any amount of time.

A fourth object of the invention is to provide a pill dispensing device which will automatically sound an alarm or make some other signal such as a flashing light, to inform the patient that it is time to take a certain type pill of several type pills which the device is capable of dispensing by alarm at various time intervals and to shift the time readout indicator for any particular type pill the patient took too early or too late by a simple act by the patient and without disturbing the time intervals for the other pills which were taken at their proper, predetermined times.

A fifth object of the invention is the improvement of devices capable of organizing any one of a plurality of different types of pills for a patient, and remind him it is time to take one, at predetermined time intervals.

BRIEF SUMMARY OF THE INVENTION

In accordance with one preferred form of the invention there is provided an improved and simplified pill dispenser for patients requiring medication comprising a plurality of compartments each containing one or more different kinds of pills but all of such pills falling into a class of pills having the same morning start-up time and the same time interval between the taking of each type pill, a real time clock (RTC), a control panel unique to each compartment and comprising, first and second indicators for indicating, respectively, the morning start-up time and the time interval between taking pills, and a time readout indicator indicating when the next pill is to be taken. Also provided are comparators for comparing the RTC time with the contents of the readout indicators, an alarm responsive to the coincidence of the real time and the contents of the readout indicator to alert the patient to take his pills, a first energizer for transferring the contents of the start-up time indicator to the readout indicator at the patient's bedtime, and other energizers energizable by the patient to selectively transfer either the contents of the RTC to the time readout indicator and then add the time interval in the second indicator to the contents of the time readout indicator or, alternatively, to simply add the time interval to the contents of the time readout indicator, depending on how long before or after coincidence between the RTC time and the contents of the time readout indicator occurred after the other energizer were energized.

DETAILED DESCRIPTION OF THE INVENTION

Figure 1:
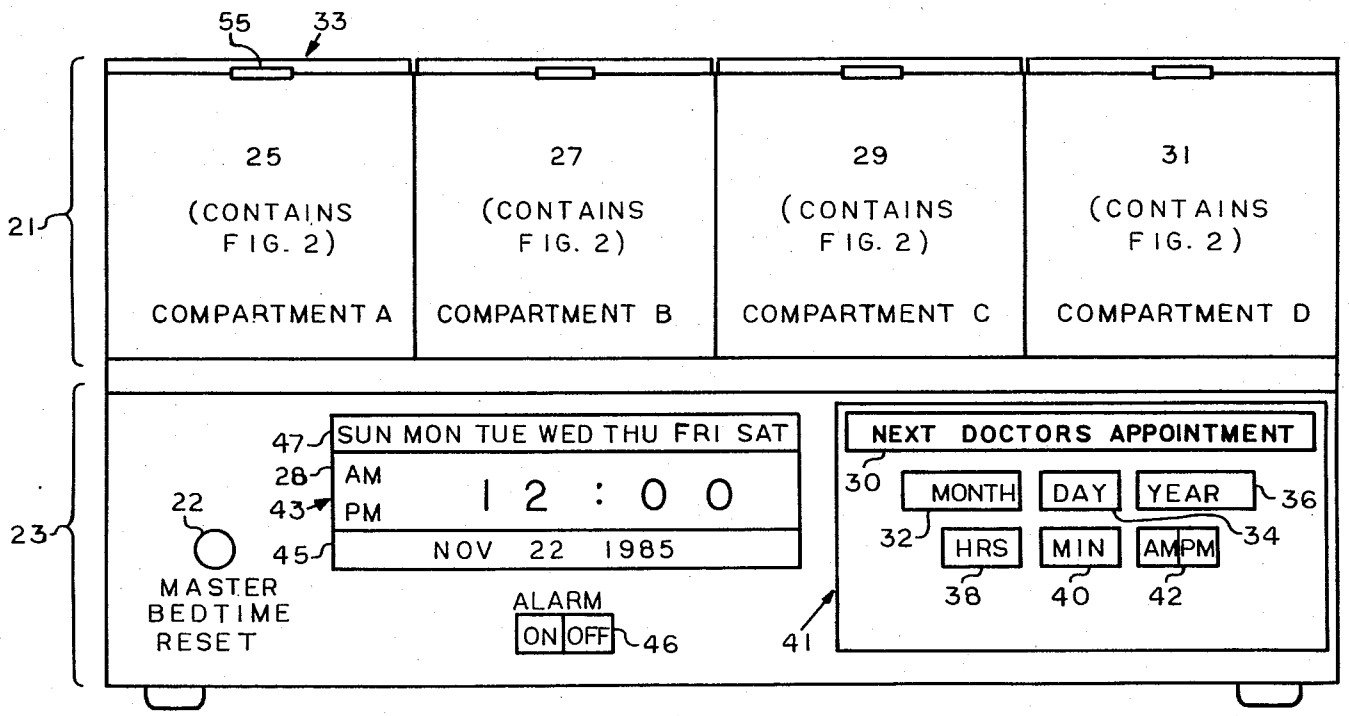
FIG. 1 shows a front view of the invention.
Figure 3:
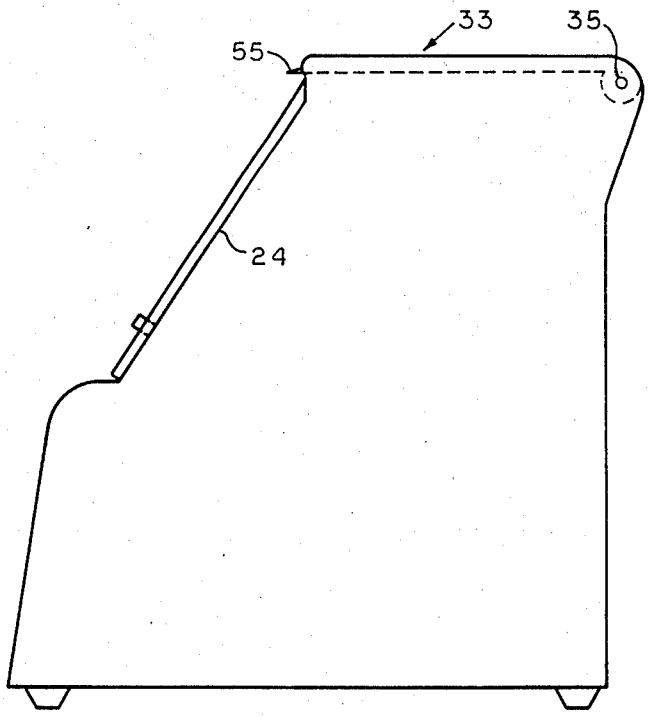
FIG. 3 shows an end view of the structure of FIG. 1.

FIG. 1, which shows the front view of the dispenser, has a side profile as shown in FIG. 3. The front view of FIG. 1 is divided into two sections 21 and 23, with the upper section 21 having four compartments 25, 27, 29, and 31, each containing one or more bottles of pills in their original containers and with each of the four compartments containing different types of pills. If two or more different types of pills are to be taken at the same time during the day, they can be kept in the same compartment of compartments 25, 27, 29, and 31.

Figure 2:
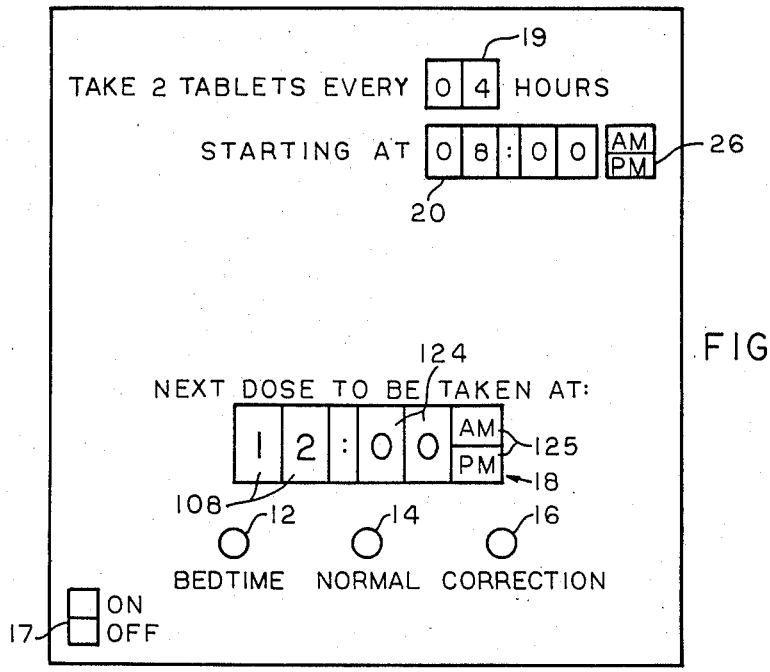
FIG. 2 shows an enlarged and more detailed view of the front of one of the pill compartments.

A more detailed showing of one of the compartments 25, 27, 29, and 31, all of which can be identical, is shown in FIG. 2. In FIG. 2 the phrase "Take 2 Tablets Every 0 4 Hours" is changeable if desired. More specifically, the phrase "Take 2 Tablets Every" can be a replacable printed tab to provide for other dosages, or even different dosages of two or more different kinds of pills with color or number coding to distinguish the pills one from the other.

It should be noted that the same color or number coding can be used to mark the lid, such as the lid 33 of compartment 25 of FIG. 1, which lid can be opened by means of hinge 35 of FIG. 3 and tab 55 also of FIG. 3, to access the pill bottle holding compartment lying thereunder. Each of the remaining three compartments 27, 29, and 31 can have hinged lids corresponding to hinged lid 33 of compartment 25.

In FIG. 2 the marking 0 4 labeled 19, can be a thumb wheel operated switch consisting of a set of two discs with the left disc, which shows an "0" in FIG. 2, also having a 1 and a 2 thereon, and the disc to the right thereof, which shows a "4" in FIG. 2 also having the numerals 0, 1, 2, 3, and 5–9 thereon so that the time intervals can be set by the patient to show any time period from 1 hour to 24 hours. The words "Hours" label of FIG. 2 can be a changeable tab or it can be permanently printed on the compartment face, as shown.

Figures 4, 6A:
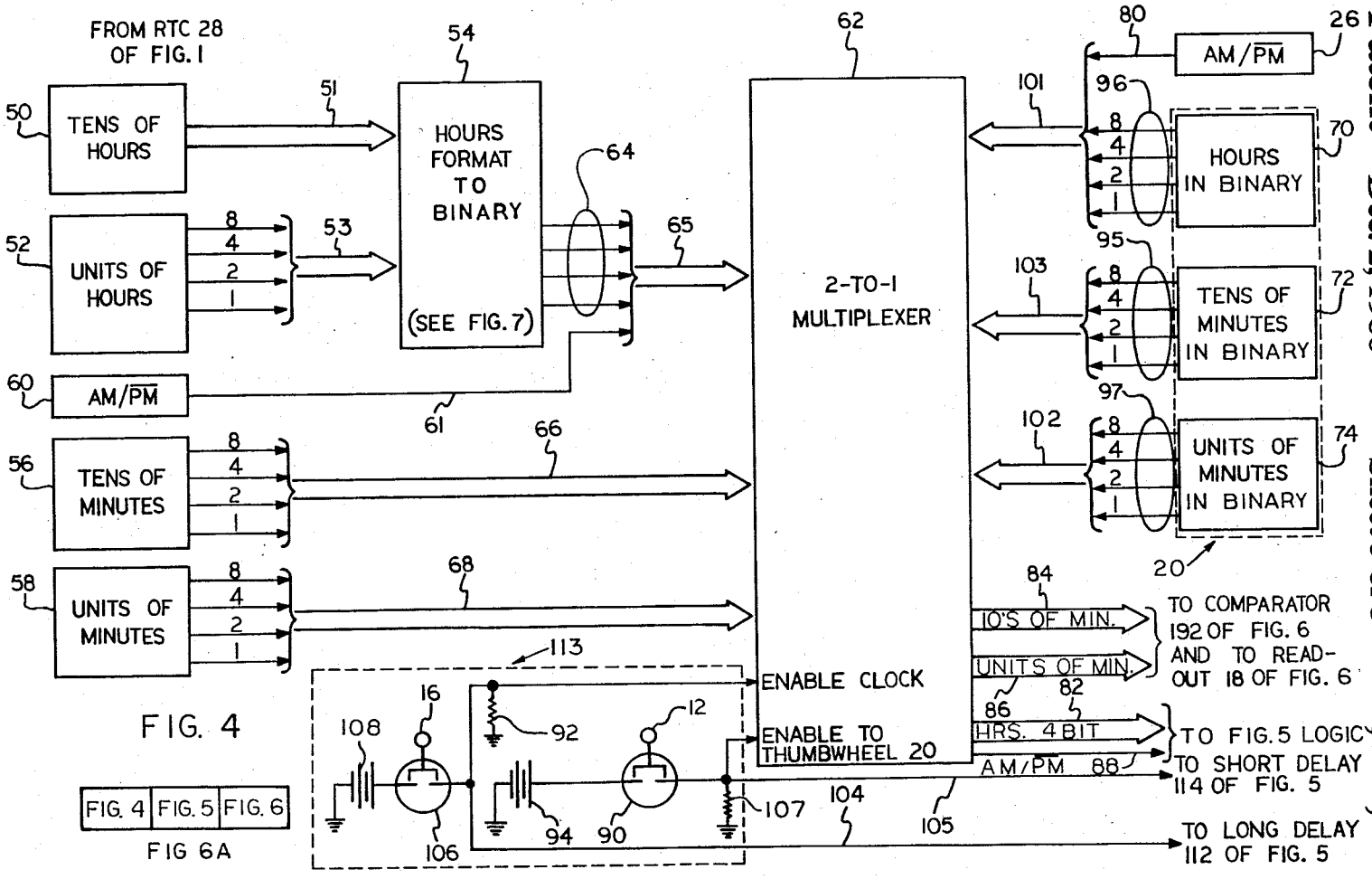
FIGS. 4, 5, and 6, considered together, as shown in FIG. 6A, is a block diagram of logic of the invention.

The next line reading "Starting at 0 8:0 0" labeled 20, consists of the changeable printed phrase "Starting at" followed by a thumb wheel operated switch which is set at 0 8:0 0 in FIG. 2. The patient can change this time to any other time he selects. If operated by thumb operated wheels, it is desirable to have the units and tens of minutes operated by separate thumb wheels and the hours by a single thumb generated wheel which causes the hours count to be selectable from 1:00 to 12:00. Minutes are also selectable. Thumb wheel operated switches 19, 20, and 26 could also be a register or a counter in other designs with an LED or LCD display and will sometimes be referred to herein as a register, indicator or a counter. Thumb operated switch 26 can be set to AM or PM. Thumb wheel switch 20 is shown in FIG. 4, as blocks labeled 26, 70, 72, and 74 with output leads 80, 96, 95 and 97, respectively.

The next line in FIG. 2 reads "Next Dose To Be Taken At" followed by the readout indicator 18 which is a combination register and readout, referred to herein both as a register and a readout and which indicates when the next pill is to be taken. Readout indicator 18 is divided into sections indicating hours 108, minutes 124, and AM/PM 125. Although this indicator 18 shows a time of 12:00, this is not the real time, but only a setting which does not change until it (the 12:00 setting) coincides with the arrival of real time 12:00 which is shown by the real time clock (RTC) 28 of FIG. 1 followed by the patient's immediate taking of his pills and the depressing of reset button 14, of FIG. 2 or, if the pills are taken too early or too late, the depressing of reset button 16, of FIG. 2 or, as a third possibility, the depression of the bedtime button 12, of FIG. 2 all of which will be described in more detail later.

The extreme right hand block of FIG. 2 the readout 18 indicates whether the time setting is AM or PM. All of the numerals in indicators 19, 20, and 18 of FIG. 2 can be either LED or LCD units activated by logic circuits to be discussed later herein.

It should be noted that the thumb operated counters 19 and 20 are accessible by sliding out the plastic panel 24 shown in FIG. 3. Furthermore, once set by the patient the time interval set into counter 19 of FIG. 2 and the morning starting time set into counter 20 of FIG. 2 will remain the same until changed by the patient. The setting in readout register 18 of FIG. 2 will be changed by three different procedures activated by the patient and which will be discussed in detail below.

Depressing the bedtime reset button 12 of FIG. 2 will load register 18 via the control circuits of FIGS. 4–7, to be discussed later, with 8:00 AM or whatever is dialed into register 20. Also the time set into readout register 18 will become set at 8:00 AM, which is the real time the patient is to take his first pill of the new day. Each time the patient takes his pill on time the register 18 will be incremented by the number 4, or any other number stored in counter indicator 19 of FIG. 2.

More specifically, for example, if the patient takes his first pill at 8:00 AM when the first alarm of the day sounds, and then depresses reset button 14, the time setting of 8:00 AM set into readout register 18 by the depression of the bedtime reset button 12 the previous night, will be incremented by 4, the number of hours set into counter indicator 19. The readout register 18 will then show a time of 12:00 noon, which is the time the patient should take his next pill. If the patient again takes his pill on time and depresses reset button 14 the readout register 18 will again be incremented by 4 and will read 4:00 PM, the time the patient should take his next pill.

It should be noted that the time indicated by readout register 18 does not necessarily bear any true relationship with the actual, real time of day, as indicated by RTC 28 of FIG. 1, except at coincidence when the alarm goes off.

It is obvious, however, that if the patient does not take his next pill until 12:30 PM, then presses button 14 the readout register 18 will still be incremented by 4 to read 4:00 PM, so that when the patient takes his next pill at the time the next alarm goes off, which will be 4:00 PM by readout register 18, also referred to herein as a readout indicating time (RIT). He would then be taking his medicine 3½ hours later. This would mean he was 30 minutes late the last time and will be 30 minutes early the next dosage. If the nature of the medication is such that this is unacceptable then a second manner of resetting is required.

The second manner in which the time indicated by register 18 will need to be corrected is when the patient takes his pill before or after the time indicated by register 18. Assume that register 18 indicates 4:00 PM and that he took his pill 1½ hours late, (5:30 p.m.), and that while register 18 indicates pill time to be 4:00 PM, the real time would be 5:30 PM. If now the patient takes his pill he is a full 1½ hours late.

By depressing reset button 16 of FIG. 2 the patient will automatically set the time indicated by register 18 as being 9:30 PM, the time he is to take his next pill. It can be seen that the difference between 4:00 PM indicated by register 18 (before depressing reset button 16) and the real time of 5:30 PM is 1½ hours. When reset button 16 is depressed register 18 not only is set to the real time of 5:30 PM but is also simultaneously incremented by 4, the value in counter 19 of FIG. 2, so that register 18 will indicate the time of 9:30 PM as when the patient should take his next pill.

It is to be understood that another compartment might have the value 03 stored in its counter indicator 19. In such a case the time 8:00 AM will be incremented by 3 to read 11:00 AM after the patient takes his first pill at 8:00 AM and depresses reset button 14. Should the patient take his 3 hour interval pills too early or too late by any time interval, he would depress reset button 16 of FIG. 2 to set the time in register 18 to the real time of real time clock 28 of FIG. 1, plus the 3 additional hours contained in the counter corresponding to counter 19 of FIG. 2.

Figure 5:
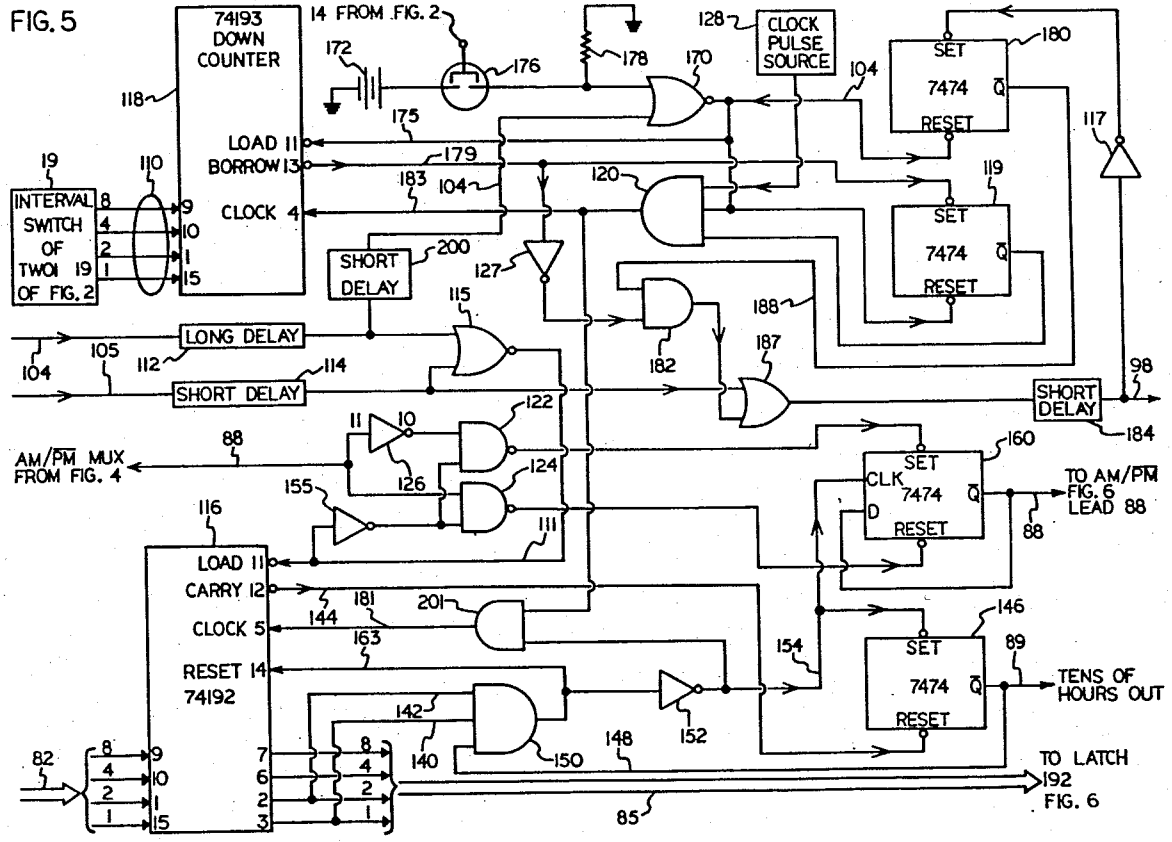
Figure 6:
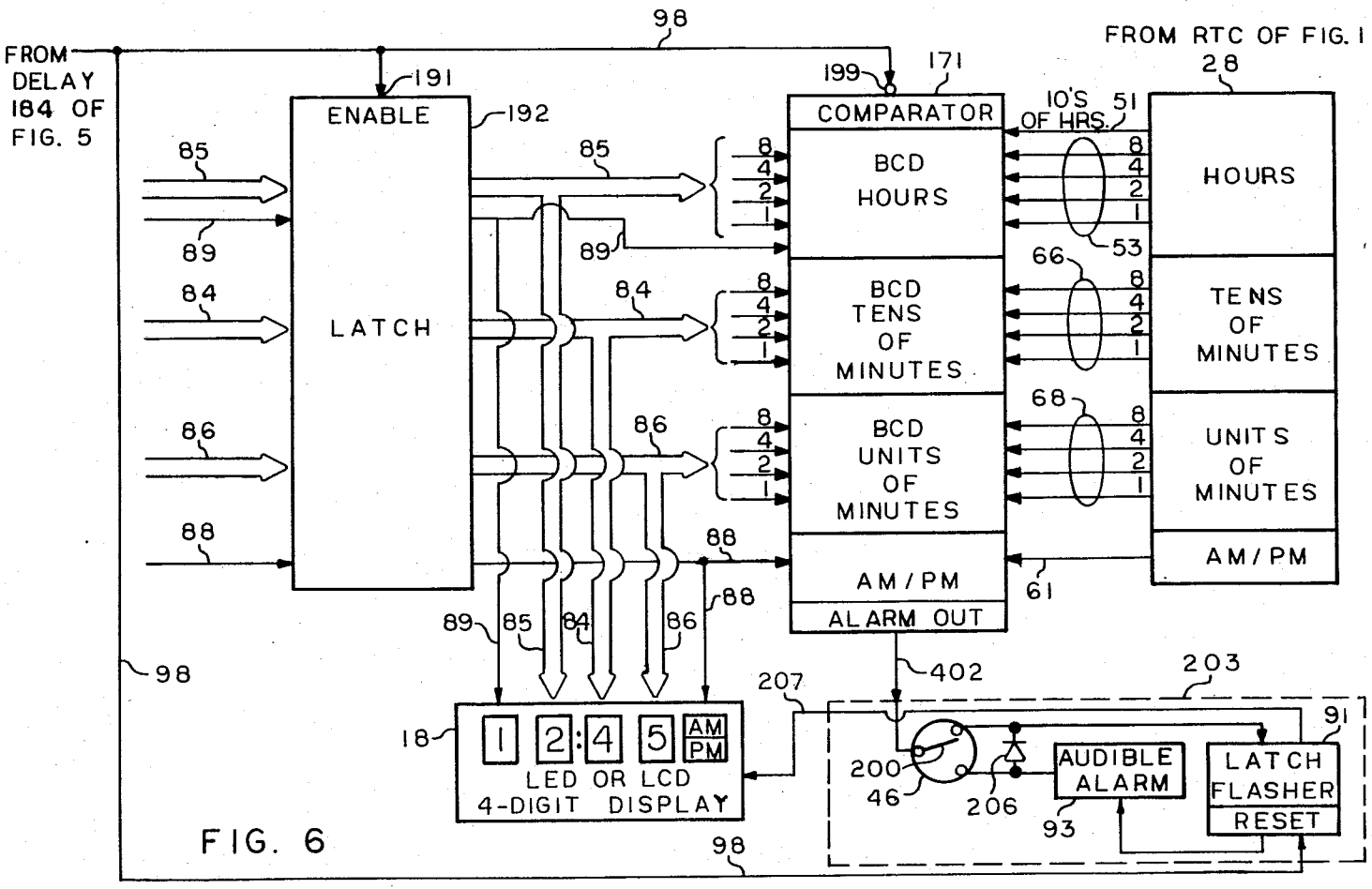

The "on-off" switch 17 of FIG. 2 (not shown in the detailed schematics of FIGS. 4, 5, and 6 but functions to turn off the power supply to an unused compartment. The power supply, which can be conventional, is also not shown in the drawings, but merely activates or deactivates the particular compartment it relates to. Deactivation, of course, will be used if the compartment is not in use at that time, i.e., contains no pills.

Referring now to FIG. 1 again the lower portion 23 thereof is common to all of the individual compartments 25, 27, 29, and 31 of the upper portion 21 of FIG. 1. Lower portion 23 contains a unit 43 which contains a conventional real time clock 28, a calendar 45, and also shows the day of the week by means 47.

All of the various time indicating displays are comprised of either LCD or LED units and are dynamic in that they always show the present time condition. For example, the date display 45 will change each day to show the correct date, and the true or actual day of the day of the week display 47 will be the only day of the display which is illuminated and will, of course, change each day.

An alarm set switch 46 of FIGS. 1 and 6 is operable by the patient to selectively enable both the audible and the visual alarm indicating that a pill is to be taken, or, if the patient desires, the audio alarm can be deactivated by moving the switch 46 to the off position leaving only the visual alarm which can be indicated by flashing on and off of the register indications such as shown in register 18 of FIG. 2.

The displays 30, 32, 34, 36, 38, 40, and 42 of FIG. 1 are all thumb operated display devices to show the month, day, year, hour, and minutes of the next doctor's appointment and whether it is in the morning (AM) or afternoon (PM).

A common bedtime reset button 22 is provided which can either replace all of the individual bedtime reset buttons of the upper departments of FIG. 2 or can be used in lieu of them, but keeping both the common bedtime reset button 22 of FIG. 1 and the individual ones of FIG. 2 on the device to give the patient a choice of which one to use.

It is to be noted that separate control panels for each pill compartment can be located on the common portion 23 of FIG. 1 with each separate control panel containing indicators corresponding to indicators 19, 20, and 18 of FIG. 2 and reset buttons 12, 14, or 16, of FIG. 2 or their equivalents, and the on/off switch 17 of FIG. 2. Also, the various indicators 19, 20, and 18 for each compartment can be set electrically by a common keyboard and under control of a microcomputer in lieu of the hardwired hardware of FIGS. 4–7 herein. Referring now to FIG. 4 there is shown a combination schematic and block diagram of part of the circuit for selectively transferring (after processing) the contents of the RTC 28 plus the contents of 19 of FIG. 2 of FIG. 1 or the contents of the thumb operated indicators, such as indicator 20 of FIG. 2, to the comparator 171 of FIG. 6, and the readout register 18 of FIGS. 2 and 6 upon depressing reset buttons 16 or 12, respectively. Also included in FIG. 4 is the multiplexor 62 which connects the contents of either the RTC 28 or the contents of indicator 20 of FIG. 2 to readout register 18 of FIGS. 2 and 6 and comparator 171 of FIG. 6 upon depression of reset buttons 16 or 12, of FIG. 2 respectively, and further by means of logic 54, generates binary values from the tens of hours to block 50 and the units of hours in block 52 and also supplies the 10's of minutes and the units of minutes as binary values from logic blocks 56 and 58 of FIG. 4.

It should be noted the output of RTC 28 blocks 50, 52, 60, 56, and 58 are assumed to be in a format which is normally used to drive a binary to seven segment display logic.

More specifically, in FIG. 4 the blocks 52 and 50 which represent, respectively, units and tens of hours having four outputs for units of hours each represented by binary code, and a single lead for hours, and which are supplied via 4 lead cable 53 and single lead 51 from a segment driven format to binary coding logic block 54 which transforms the set of 4 lead coding representing units of hours and the single lead 51 representing hours into a single set of 4 leads 64 which represents in binary code the time in hours from the RTC 28 of FIG. 1. The 4 lead binary output 64 of logic block 54 and also the single lead output 61 of the AM/PM section 60 of RTC 28 are supplied to 2-to-1 multiplexor (MUX) 62 via 5 lead cable 65.

The tens and units of minutes are supplied from the RTC 28 of FIG. 1 in 4 lead binary form which are shown in FIG. 4 as being supplied to MUX 62 via cables 66 and 68.

The hours from the thumb wheel operated indicator (TWOI) 20 are supplied in binary format to MUX 62 via the 4 binary leads 96 and 5 lead cable 101, which also contains the single lead output 80 from the AM/PM section 26 of the TWOI 20.

The 3 output cables 82, 84, and 86, and AM/PM lead 88 of FIG. 4 transfer either the output from the RTC 28 or the output from the TWOI 20 ultimately to the comparator 171 of FIG. 6 by controlling MUX 62 by the logic within the dashed line block 113 of FIG. 4. It should be noted that cables 84 and 86, which contain the tens and units of minutes, are connected to comparator 171 via latch 192 of FIG. 6 while 4 lead cable 82 and AM/PM single lead 89 are first connected directly to the logic of FIG. 5 where further processing occurs, as will be discussed later herein.

Normally, MUX 62 of FIG. 4 will connect the cables 101, 103, and 102 of the output of TWOI 20 to the output cables 82, 84, and 86 of MUX 62 which also has single lead AM/PM ouput 88. However, when it is desired to connect the RTC 28 to cables 82, 84, and 86 and single lead 88 the reset button 16 of FIGS. 2 and 4 is depressed (as shown in detail in FIG. 4) by the patient which overides the ground through resistor 92 and connects positive 5 volts from battery source 108 directly to MUX 62 through switch 106 and to lead 104 and causes it to switch, thereby disconnecting TWOI 20 from output cables 82, 84, 86 and single lead 88, and connecting the output of RTC 28 to such output cables 82, 84, 86 and single lead 88. It should be noted that lead 104 will go through several components without a reference character change.

At the same time lead 104 will connect through long delay 112 of FIG. 5 which goes to load pin 11 of up/down counter 116 of FIG. 5 through NOR gate 115 via lead 111 to initiate the necessary loading of up/down counter 116 with the binary data of cable 82 of FIG. 5 and processing (e.g., ultimately incrementing counter 116 by the number stored in TWOI 19 of FIG. 2) to establish the time for the patient's taking of the next pill.

If reset button 12 of FIG. 2 is depressed, as at bedtime, +5 volt battery source 94 will be connected through switch referenced 90 of FIG. 4 enabling MUX 62 with the +5 volt signal on lead 105 to transfer the contents, hours, 10's of minutes, units of minutes, and AM/PM signal of TWOI 20 through the MUX 62 of FIG. 4 to their proper destinations. The +5 volt signal on 105 is also be connected through short delay 114 of FIG. 5, to gates 115, and OR gate 187 of FIG. 5. When not depressed, reset button 12 permits switch 90 to remain open to allow ground to be connected directly through resistor 107 and to short delay 114 and then continue on as load line 105 so that no transfer will occur since the load input pin 11 of counter 116 is not activated because the low level ground signal is inverted to a high level signal by NOR gate 115.

As indicated above, cables 84 and 86 go directly to the latch 192 of FIG. 6 and then to the comparator 171 of FIG. 6. Only cable 82 the AM/PM lead 88, and load lines 104 and 105 go to FIG. 5 for the following reasons.

If the time in readout 18 is 08:00 AM but the patient did not take his pill until 09:30 AM, he will want to schedule the next pill for 4 hours later, or at 01:30 PM. Consequently, he will depress reset button 16 which will necessitate the real time of 09:30 AM to be incremented by 4. Unless correcting logic is provided the 9:30 AM time would advance to 13:30 rather than to the desired 01:30 PM.

A similar case arises if the patient has taken his last pill on the indicated readout time when the alarm 93 of FIG. 6 sounded (to be discussed later) upon coincidence of the readout 18 time and the RTC at, say 11:00 AM. The patient would depress reset button 14 of FIGS. 2 and 4 so that the readout 18 time of 11:00 AM would be incremented by 4 hours. Unless correcting logic is provided the new readout time would be 15:00 instead of 03:00 PM.

The logic of FIG. 5 provides this correcting logic.

Consider the case where the patient takes his pill late, at 09:30 AM. The output on cable 82 (hours only, in 4 bit binary format), of FIG. 4 is loaded into up/down counter 116 of FIG. 5 and is registered thereon as 09:30 AM, upon the signal on load line 104 going low by virtue of NOR gate 115. It is to be noted that the minutes are shown for reference only. The output of NOR gate 115 also goes to one of the inputs of NAND gates 122 and 124 through lead 111 and inverter 155. The other inputs of NAND gates 122 and 124 receive, respectively, the inverted form of the AM/PM indication through inverter 126 and the non-inverted form of the AM/PM indication, thus fully enabling one of the two NAND gates 122 or 124 depending on whether it is AM or PM. This will allow the processing of lead 88 which is the AM/PM lead.

Load line 104, after the high level signal thereon goes low upon passing through short delay 200 of FIG. 5 and NOR gate 170. This loads the contents of TOSI 19 via cable 110 of FIGS. 2 and 5 into counter 118 of FIG. 5 with a 3 (binary) but will decrement counter 118, by 4, as will be explained later.

Furthermore, load line 104 goes through short delay 200 (FIG. 5) and NOR gate 170 to reset flip-flip 119 causing $\overline{Q}$ to go high and thereby priming AND gate 120. It should be noted that load line 104 also functions to inhibit AND gate 120 until the load signal ends to avoid conflict of signals.

As a result of the priming of AND gate 120, when $\overline{Q}$ of flip-flop 119 goes high as a result of the load signal 104 on the reset pin, four positive pulses from pulse source 128 will pass through AND gate 120 and output lead 183 (after the low level load signal ends) to produce four positive pulses which will pass through AND gate 201 via lead 181 to be supplied to input pin 5 of up counter 116 to increment the hour count (09:30 AM) by 4.

The 4 pulses supplied to input pin 4 of the down counter 118, which was set to 3 by the load signal on pin 11 thereof to load the contents of SWOI 19 therein, will cause down counter 118 to count down to 0 at which time the borrow pin 13 thereof will go low to set flip-flop 119 via lead 179 and thereby cause $\overline{Q}$ of flip-flop 119 to go low to disable AND gate 120 and prevent further pulses from pulse source 128 from passing through.

It should be noted in the following explanation that the only time being incremented is the hour, and the AM/PM is being toggled. The minutes are used for explanation only.

As the 4 pulses are entered into up/down counter 116 on pin 5, via lead 181, the first pulse will cause the count to go from 9:30 AM to 10:30 AM causing the carry lead 12 to go low and the binary 1 output lead 140 to go low because the output of counter 116 is BCD coded. Also, the flip-flop 146 is reset causing $\overline{Q}$, which is labeled lead 89 and represents the 10's of hours, to go high, and which goes to the latch 192 and comparator 171 of FIG. 6. At the next pulse (the second pulse) the binary 1 output lead 140 will go high and the binary 2 output lead 142 will remain low. The count goes from 10 to 11. At the third count from pulse source 128 the lead 140 will go low and the lead 142 will go high. The count goes from 11 to 12. At the fourth count of pulse source 128 both the leads 140 and 142 will go high and the output goes from 12 to 13 and this generates a reset pulse that is explained in the following paragraphs.

It should be noted that when the carry lead 144 went low and flip-flop 146 was reset and the $\overline{Q}$ thereof went high AND gate 150 was also primed via lead 148. Then, when leads 140 and 142 of the output of counter 116 both went high (this decodes a count of 13) AND gate 150 became conductive and passed a high pulse to inverter 152 which in turn produced a low level signal on lead 154 to set flip-flop 146, driving $\overline{Q}$ thereof low, and also was supplied via lead 154 to the clock input of flip-flop 160 to cause flip-flop 160 to toggle from its AM state to its complement PM state.

When the output of AND gate 150 went high, due to the leads 140 and 142 going high, the output of the up counter 116 was cleared to 0 via a high level signal supplied via lead 163 to reset pin 14 of counter 116. It should be noted on the fourth pulse AND gate 150 becomes conductive and clears counter 116 very quickly, long before the fourth pulse has ended. Thus, when counter 116 is cleared output leads 140 and 142 go low and carry lead 144 goes high. Also, flip-flop 146 was set when AND gate 150 became momentarily conductive, causing the low level output of inverter 152. Since the fourth pulse is still present at the input of AND gate 201 and the reset pulse from AND gate 150 through invertor 152 produced a quick negative pulse on lead 154 to the other input of AND gate 201 through lead 154. The effect on counter 116 is that of a fifth pulse occurring, (counter 116 counts on the rising edge of a pulse) and the effect is the same as dividing the fourth pulse into two separate pulses, or generating a fifth pulse. This drives the count from 0 to 1.

The net effect is that the hours were incremented by 4 from 9 AM to 1 PM. The units of hours are carried by 4 lead cable 85 and the tens of hours by single lead 89, all shown in FIG. 5 and with both 4 lead cable 85 and single lead 89 going to latch 192 of FIG. 6.

It is also necessary to wait before using the output of up counter 116 until all counting has ceased and the new time (hours) is set into up counter 116. To accomplish the foregoing flip-flop 180, OR gate 187, AND gate 182, inverter 117, and the short delay 184 are included in FIG. 5.

$\overline{Q}$ of flip-flop 180 is set high initially by the low level load signal on load line 104 (via NOR gate 170 to prime AND gate 182 via lead 188. Then, upon the occurrence of a low level borrow signal on pin 13 of flip-flop 118 which becomes high due to inverter 127 the AND gate 182 becomes conductive and passes a high level signal through short delay 184, the output of which goes to four destinations. One of these destinations is back through inverter 117 to the set input of flip-flop 180 to disable AND gate 182, thereby insuring that only a short pulse is supplied to the other three destinations which include the read-in input 191 (active high) of latch 192 of FIG. 6 via lead 98, the compare enable input 199 (active low) of comparator 171 of FIG. 6 and the reset input of latch flasher 91 of FIG. 6 (active high).

In the foregoing manner the new time of 01:30 PM will be set into readout 18 and the comparator 171 to be compared to the RTC by the comparator 171.

Because only the final setting of the foregoing process is to be compared with the actual time of the RTC, a sample and hold (S & H) circuit 192 (or latch) is provided in FIG. 6. The S & H logic 192 will store, only the new time, which is the time for the next dose, when the load signal 98 of FIGS. 5 and 6 occurs as a result of pressing either reset button 12, 14 or 16, thus insuring that the time being compared with the actual time on the RTC does not change during the incrementing process.

However, the time on the RTC will change by minute increments. In other words the RTC will remain at 09:30 AM for one full minute and then will change to 09:31 AM. However, as will be explained below only the alarm 93 of FIG. 6 of alarm system 203 is made to operate for one full minute, from 09:30 AM to 09:31 AM by means of alarm output 402 which is only high when the RTC time is the same as the time supplied from S & H logic 192.

The two pole switch 46 (see FIG. 1) connects the alarm output to arm 200 of FIG. 6 either to the flashing unit 91 by itself or to both the audible alarm 93 and via diode 206 to the flashing unit 92, which is connected to readout 18 by lead 207. It is to be noted that flasher/-latch 91, once energized, will continue flashing readout unit 18 until one of the three reset buttons, 12, 14, or 16 is depressed which energize reset lead 98.

Referring again to FIG. 5 the switch 176 corresponds to the normal reset button 14 of FIG. 2 and initiates a process whereby 4 hours are added to the current readout 18 reading. When reset button 14 is depressed the volt source 172 supplies +5 volts from battery 172 to NOR gate 170 where it is inverted to a low level signal and supplied to the load input pin 11 via lead 175 of down counter 118, and reset input of flip-flop 119 and flip-flop 180 all of which require a low level signal to be activated. This process of adding 4 hours is the same action as was described earlier.

Releasing button 14 disconnects battery source 172 and connects ground to NOR gate 170 through resistor 178 where it is inverted to a high level signal and will not activate any of the above named logic elements.

Figure 7:
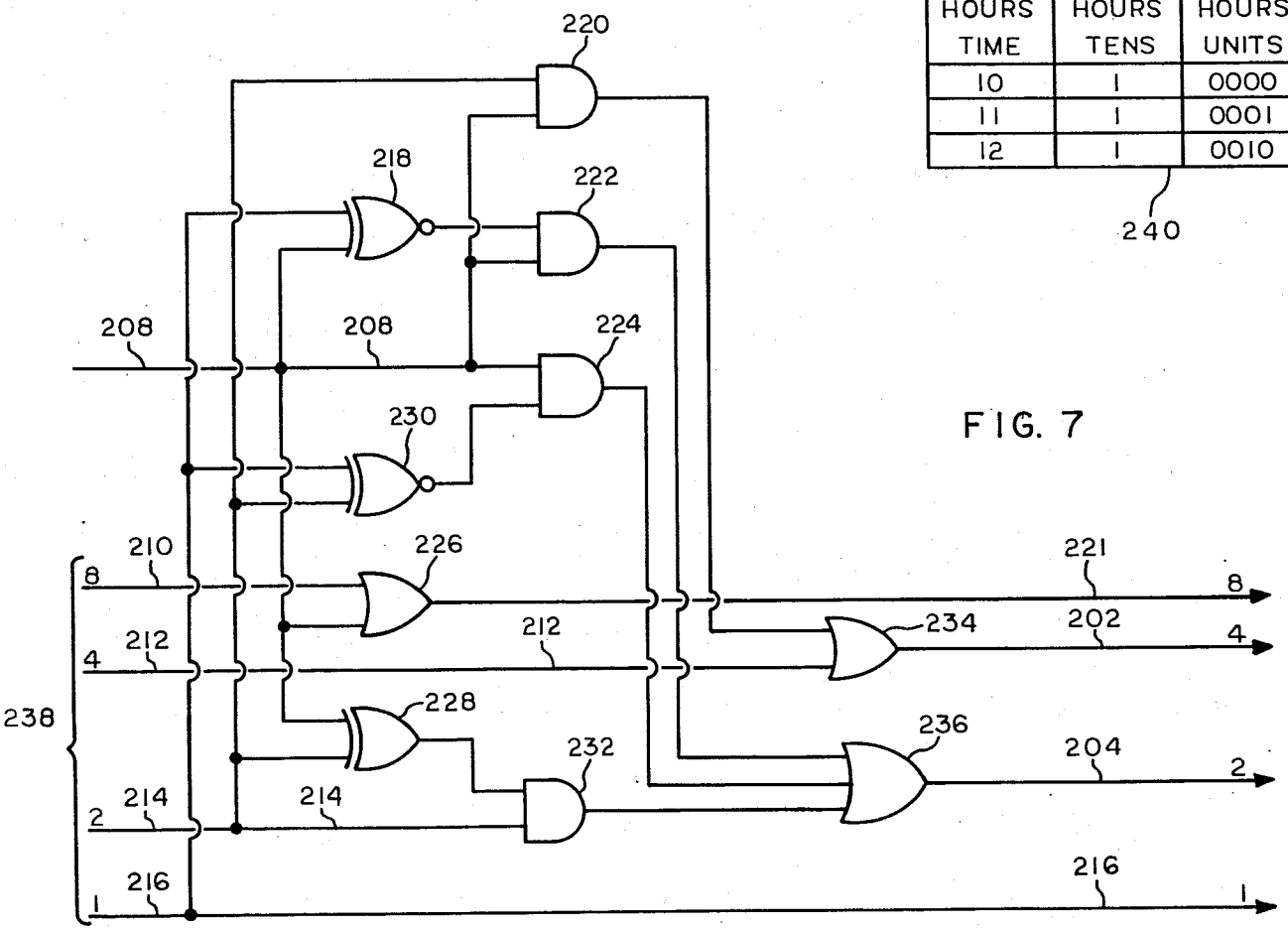
FIG. 7 is a logic diagram of block 54 of FIG. 4.

FIG. 7 shows the detailed logic of block 54 of FIG. 4 which changes the hours format to binary which has four outputs 221, 202, 204, and 216 representing the binary values 8, 4, 2, and 1, respectively. The input 208 represents 10's of hours and will be either a 1 or a 0 and the other four inputs 210, 212, 214, and 216 represent units of hours.

It should be noted that the logic of block 54 of FIG. 4 is necessary only if the output of the real time clock is in a format which normally would be used to drive an LED or LCD display which normally uses a BCD or binary to 7 segment driver. This logic converts from the drive format to binary.

Obviously, if the 10's of hours input 208 is 0 then the four units of hours 238, represented by leads 210, 212, 214, and 216 are unaffected and the binary output from the RTC 28 to inputs 210, 212, 214, and 216 can pass straight through to the four outputs 221, 202, 204, and 216. When the 10's of hours is 0 the signal to one input of XOR gate 228 is 0 so that the output XOR gate 228 will always be the same as the input to the other input thereof. Thus, if there is a 1 on binary input lead 214 the AND gate 232 will be conductive since there will also be a 1 on the output of XOR gate 228.

If the 10's of hours input 208 is a 1 then the truth table 240 applies. More specifically, consider the case where it is 10:00 (hours only). A 1 will appear on lead 208 and a 0 on lead 216 which will cause a 0 to appear at the output of XNOR gate 218, which will disable AND gates 222, since all of the unit hour leads 210, 212, 214, and 216 have 0's on them, and particularly unit leads 214 and 216 which go respectively to AND gate 220 and XNOR gate 218.

AND gate 224 will be enabled since both inputs of XNOR gate 230 have 0's on them, and with lead 208 at a 1 level the output of gate 224 will be a 1. Thus, the inputs of AND gate 224 will have 1 on each input which will enable OR gate 236 so that a 1 will appear on the output 204 representing a binary 2. The 1 on input 208 will pass through OR gate 226 and appear on binary output 221, which is an 8. OR gate 234 will have 0's on both inputs so that a 0 will appear on output lead 202.

The final result is a binary 1010 on output leads 221, 202, 204, and 206, which is 10 (hours only) in binary.

To produce a binary of 11 it is necessary to produce a 1 on output leads 221, 204, and 216 to produce a BCD value of 1011, as shown in the truth table 240.

Output lead 221 is obviously a 1. Output lead 204 has a 1 thereon since both inputs to XNOR gate 218 have 1's thereon and AND gate 222 is enabled. Note that at 11:00 input 216 has a 1 which is supplied to the second input of XNOR gate 218.

Output lead 202 has a 0 thereon since AND gate 220 is still disabled and input 214 also has a 0 on it.

To produce a BCD of 1100, which represents 12:00, only outputs 200 and 202 must have 1's thereon. Outputs 204 and 206 must have 0's thereon. At 12:00 the units hours will have a 1 on input 214. This will cause the output of XNOR gate 230 to be 0 since input 216 is a 0. Thus, AND gate 224 is disabled to present a 0 to one of the three inputs of OR gate 236. XNOR 218 will have a 0 and a 1 on its two inputs to produce a 0 output to disable AND gate 222 and provide a 0 to a second input of OR gate 236. Both inputs to XOR gate 228 will be 1's to produce a 0 output to AND gate 232, thus providing a 0 to the third input of OR gate 236 and therefore a 0 on output lead 204.

By definition input 216 will be 0 so that output 206 will also be 0. AND gate 220 is enabled since both inputs have 1's thereon, one from input 208, and the other from input 214. Thus OR gate 234 will have a 1 output to 202. Output 221 will be high due to 226 output being high because of 208 input.

Figure 8:
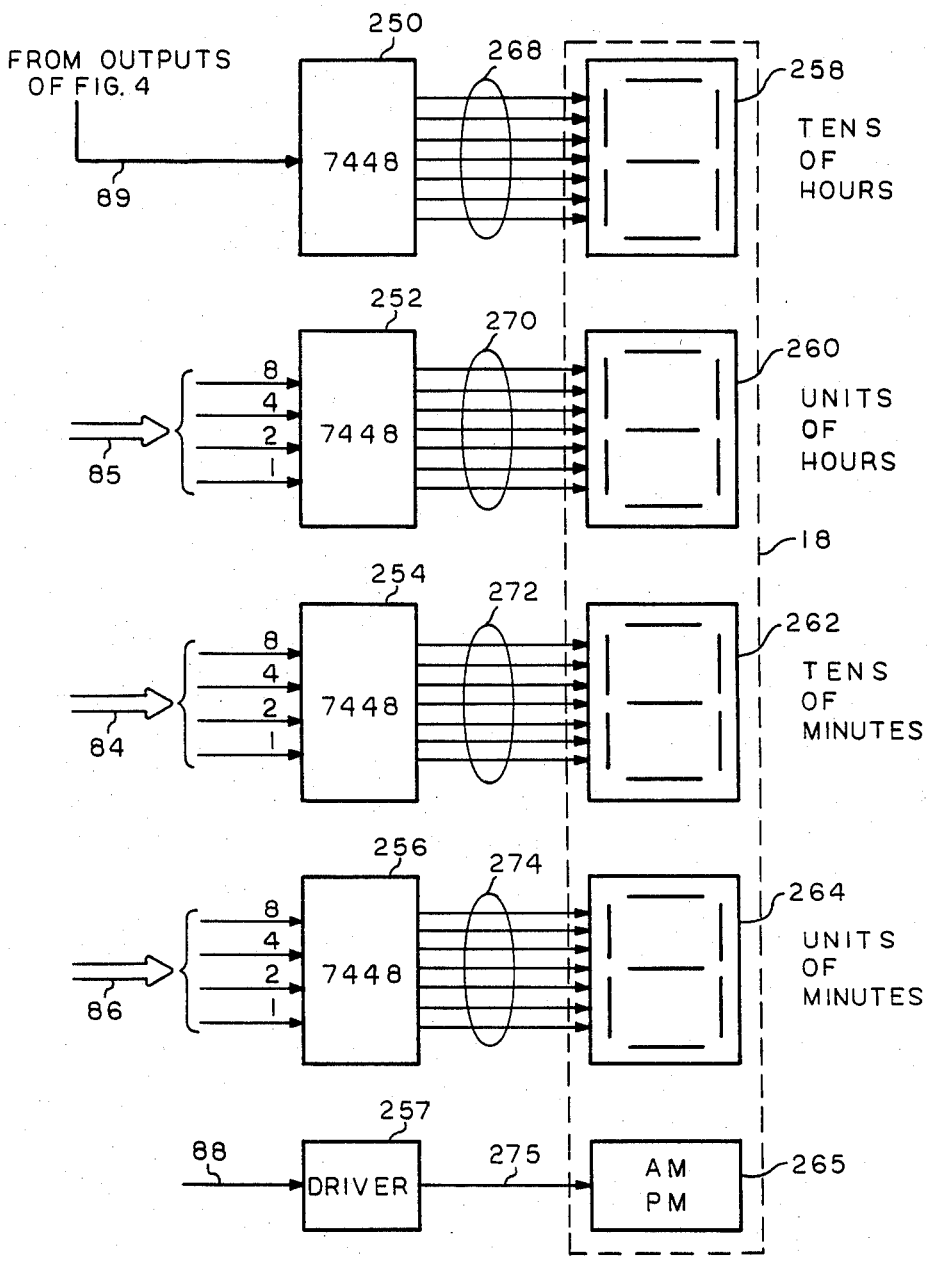
FIG. 8 shows a logic diagram of the LCD or LED readout elements with their drivers.

Referring now to FIG. 8 the BCD inputs on cables 85, 84, 86, and 89 single leads 88 and 89 from FIG. 6 are converted by logic block 250, 252, 254, 256, and 257 to seven lead outputs which selectively energize the four seven (7) segment LED or LCD display units of readout 18, and AM/PM indicator shown in FIG. 8 as blocks 258, 260, 262, 264 and 265 being driven by cables 268, 270, 272, 274 and single lead 275, to illustrate the proper time on time readout 18 when the patient should take his next pill.

Figure 9:
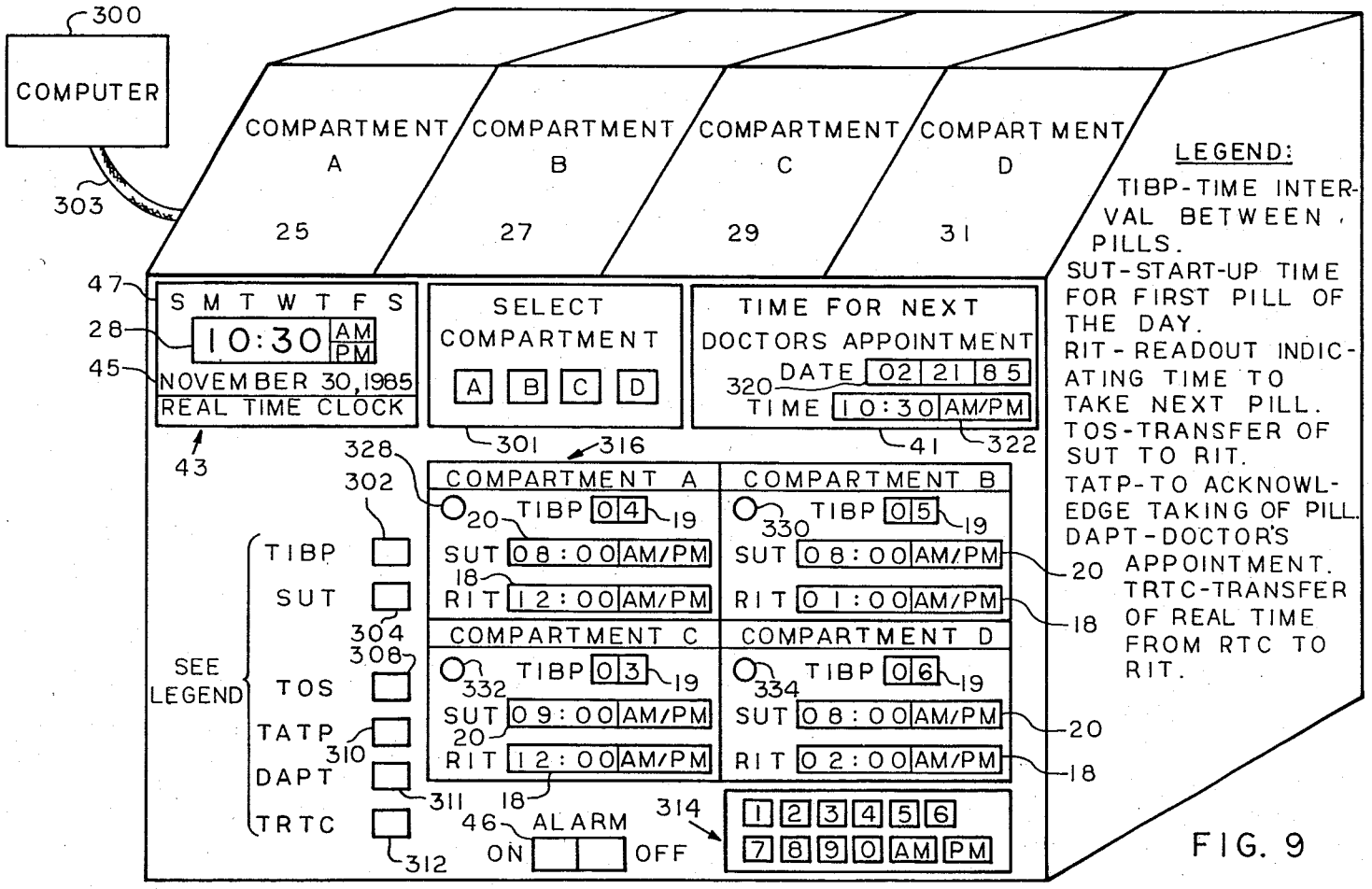
FIG. 9 is an alternative form of the invention employing a computer and a different format for the various controls and readouts.

Referring now to FIG. 9 there is shown a possible construction employing a computer 300, and with all of the various indicators and readouts for one or more compartments A, B, C, and D (four are shown for example only) set out separately and indicated by LCD or LED lighted numerals or letters or on a computer screen, and which are under control of computer 300 by means of a current loop, fiber optics, multi-wire connecting cable or other state of the art data transfer means, labeled 303.

When the alarm is energized one of the four lights 328, 330, 332, or 334 will light up indicating from which compartment the patient is take his pill.

To set the indicators 19 and 20 in any of the four compartments A, B, C, or D, the compartment is selected by depressing one of the four buttons within compartment selector 301. If indicator 19 is to be set then the time interval is punched into keyboard 314 and the TIBP (see the legend in FIG. 9) button 302 is depressed. The correct time interval will appear in TIBP 19.

To set the SUT, the compartment is first selected by depressing the appropriate button in block 301. Then, the desired SUT is keyed in keyboard 314, followed by depressing energizing SUT button 304. The correct SUT time will appear in SUT 20.

Depression of energizing button 308 will transfer the contents of SUT 20 to RIT 18.

Depressing energizing button 312 will transfer the real time of RTC 28 to RIT 18.

Incrementing of RIT by the quantity set in indicator 19 is done automatically after either depression of button 310, acknowledging the patient's taking of his pills, or depression of button 312.

Depression of energizing button 311 preceded by a continuous punching in of date and time will set block 41 which includes the date block 320 and the time block 322.

It is to be understood that depression of any of the energizing buttons will generate a code which, among other functions, will access the proper subroutines in the computer's memory to multiplex either the data generated by keyboard 314 to the proper indicator of the selected compartment or to transfer the data from one indicator to another in the control panel of the selected compartment.

It should also be noted that depression of any of the compartment select buttons in block 301 will light one of the lights 328, 330, 332, or 334 to indicate visually to the patient which compartment is being changed.

The function of alarm switch 46 has already been discussed in connection with FIG. 2.

It is assumed that the clock unit 43 has its own controls.

It is to be understood that the forms of the invention herein shown and described are but preferred embodiments thereof and that various other embodiments will be apparent to those of ordinary skill in the art without the exercise of invention, and particularly those modifications employing microcomputers or other high density chip design in lieu of hard wired logic hardware and those having separate panels for each compartment on the same common portion as the RTC and with the various indicators corresponding to the reset buttons and thumb wheel operated switches of the present invention having computor controlled electronic readout operated by a common keyboard which can select any compartment. The important feature of simplicity of understanding and operation by patients, not present in the prior art, would still be retained.

I claim:

1. An improved medication organizer comprising a plurality of compartments having a minimum of simple, easily understood controls operable by elderly people for dispensing a plurality of different classes of pills to be taken at different time intervals measured from selectable reference times and including easily understood controls for correcting the reference times for pills taken too early or too late and comprising:

first indicator means for setting a readable morning time and indicatable, when it occurs, by an audible alarm when the day's first pills should be taken;

second indicator means for indicating the different intervals of time which should elapse between the taking of different kinds of pills;

third means comprising a plurality of compartments, each dedicated to the storage of pills, which can be of different types, but all of which have the same morning starting time and the same time interval between the taking of the pills;

a real time clock with means for producing coded signals indicating hours and minutes;

a plurality of time readout means, one for reading out the time for taking the next pills of each individual compartment;

fourth means for transferring the contents of said first indicator means to said readout means in response to a signal originated by the patient at bedtime;

fifth means for incrementing the time indicated by each readout means by the amount stored in said second indicator means by the patient when he takes a pill on time; and sixth means for transferring the contents of said RTC to said time readout means in response to a signal originated by the patient when the patient believes he has taken his pill too early or too late and then incrementing said time readout means by the amount stored in said second indicator means.

2. A medication organizer as in claim 1 and further comprising:

comparator means for comparing the RTC time with the contents of said time readout means;

alarm means responsive to the coincidence of the RTC time and the time readout means to alert the patient to take the pills of a given class; and logic means responsive to energization of said fifth or sixth means by the patient to deactivate said alarm means and increment said time readout means by the quantity stored in said second indicator means, or to transfer the real time of said RTC to said time readout means followed by the incrementing of said new time readout means time by the quantity set into said second indicator means.

3. An improved and simplified method for patients to take a plurality of different types of pills during the day with each of the types of pills, which are kept in separate compartments, having the same interval of time between the taking of a pill, and comprising the steps of:

providing, for each of the different types of pills, a first indicator indicating the time interval between taking pills, a second indicator indicating the morning start-up time, a time readout indicator showing the time when the next pill is to be taken, and at least two energizing means operable by the patient at bedtime for selectively transferring the morning start-up time or the real time of the RTC time to the time readout indicator;

comparing the RTC time with the time in the time readout indicator and, when coincidence occurs, energizing a suitable alarm to alert the patient to take his pills;

energizing the appropriate one of said energizing means; and selectively transferring either the morning start-up time in said second indicator means or the real time of said RTC to said time readout indicator; and adding the amount stored in said first indicator means to said time readout means when the real time of said RTC is transferred to said time readout indicator.

4. A method as in claim 3 and comprising the further steps of:

providing a third energizing means operable by the patient; and energizing said third energizing means to increment said contents of said second indicator means by the amount stored in said first indicator means.

5. A method as in claim 3 and comprising the further steps of:

placing all of the energizing means, the first, and second indicator means, and the time readout indicator for each compartment on the surface of said each compartment to be visible by the patient; and color coding each compartment with a different color and all the pill bottles that go in that said each compartment with the same color or any other means of identifying the pill bottles to the compartment such as number or letters.

6. A medication organizer as in claim 2 and further comprising:

adjusting means adjustable by the patient for setting the desired amounts in said first and second indicator means.

7. An improved and simplified medication organizer for elderly patients comprising:

a plurality of compartments each containing one or more different kinds of pills but all of such pills falling into a class of pills having the same daily morning start-up and the same time interval between the taking of each type pill;

a real time clock (RTC);

a control panel unique to each compartment and comprising:

first and second indicator means for indicating, respectively, the morning start-up time and the said time interval between taking pills;

a time readout indicator indicating when the next pill is to be taken;

comparator means for comparing the RTC time with the contents of said readout indicator;

alarm means responsive to the coincidence of the real time and the contents of the readout indicator to alert the patient;

a first energizing means for transferring the contents of said start-up time indicator means to said readout indicator at the patient's bedtime; and other energizing means energizable by said patient to selectively transfer either the contents of said RTC to said readout indicator and then add the time interval in said second indicator means to the contents of said readout means or, alternatively to simply add said time interval to the contents of said readout indicator, depending on how long before or after said coincidence between said RTC time and the contents of said readout indicator said other energizing means was energized.

8. A medication organizer as in claim 7 in which said other energizing means comprises:

second energizing means energizable by the patient to increment the time readout indicator by the amount contained in said second indicator means; and third energizing means energizable by the patient to transfer the real time of said RTC to said time readout indicator and then to increment said time readout indicator by the amount contained in said second indicator means.

9. A medication organizer as in claim 7 in which said other energizing means comprises a second energizing means operable by the patient to transfer the real time of said RTC to said time readout indicator and to then increment said time readout indicator by the amount contained in said second indicator means.

10. A medication organizer as in claim 7 and further comprising:

comparator means for comparing the RTC time with the time readout indicator; and alarm means responsive to the coincidence of the RTC time and the time readout indicator to alert the patient to take the pills of a given class; and logic means responsive to energization of said other energizing means by the patient to deactivate said alarm means, transfer the real time of said RTC to said time readout indicator followed by the incrementing of said new time readout indicator time by the quantity set into said second indicator means.

11. An improved and simplified medication organizer for patients to take a plurality of different types of pills but all being in the same class in that they have the same starting time and the same time interval between the taking of pills and comprising:

a separate compartment for each class of pills;

a real time clock (RTC) common to all of said compartments;

each given compartment having a separate set of controls unique thereto and comprising;

a first indicator settable by the patient for establishment of the time interval between the taking of the class of pills in the given compartment;

a second indicator means settable by the patient for establishment of the morning start-up for a given class of pills;

a time readout indicator for indicating the time the next pills of the given class should be taken;

first energizing for setting the time indicated by said second indicator means in said time readout indicator;

second energizing means operable by the patient for incrementing the time set in said time readout indicator by the time interval set in said first indicator means;

third energizing means operable by said patient for setting the RTC time into said time readout indicator when the patient has taken his pills too early or too late and incrementing said readout indicator time by the time set into said first indicator means.

12. A medication organizer as in claim 11 and further comprising:

comparator means for comparing the RTC time with the readout indicator means; and alarm means responsive to the coincidence of the RTC time and the time readout indicator to alert the patient to take the pills of a given class; and logic means responsive to energization of said second or third energizing means by the patient to deactivate said alarm means and increment the time readout indicator by the amount stored in said first indicator means and to transfer the real time of said RTC to said time readout indicator followed by the incrementing of said new time readout indicator time by the quantity set into said first indicator means.

* * * * *